US011854482B1

(12) United States Patent
Lu et al.

(10) Patent No.: US 11,854,482 B1
(45) Date of Patent: Dec. 26, 2023

(54) PIXEL DRIVE CIRCUIT AND DISPLAY PANEL

(71) Applicant: HKC CORPORATION LIMITED, Shenzhen (CN)

(72) Inventors: Zhaoyang Lu, Shenzhen (CN); Rongrong Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/356,592

(22) Filed: Jul. 21, 2023

(30) Foreign Application Priority Data

Nov. 28, 2022 (CN) ..... 202211498015.6

(51) Int. Cl.
*G09G 3/3233* (2016.01)

(52) U.S. Cl.
CPC ... *G09G 3/3233* (2013.01); *G09G 2300/0842* (2013.01); *G09G 2310/08* (2013.01); *G09G 2320/0233* (2013.01); *G09G 2320/045* (2013.01)

(58) Field of Classification Search
None
See application file for complete search history.

(56) References Cited

U.S. PATENT DOCUMENTS 11,250,783 B2 * 2/2022 Hu ..... G09G 3/3266
2005/0083270 A1 * 4/2005 Miyazawa ..... G09G 3/3291 345/76
2011/0285691 A1 * 11/2011 Takasugi ..... G09G 3/3233 345/82
2012/0293478 A1 11/2012 Chaji et al.
2016/0203759 A1 * 7/2016 Han ..... G09G 3/3233 345/212

(Continued)

FOREIGN PATENT DOCUMENTS

CN 104409047 A 3/2015
CN 109920371 A 6/2019

(Continued)

OTHER PUBLICATIONS

Notification to Grant Patent dated Jan. 28, 2023 in corresponding application No. 202211498015.6; 3 pages.

(Continued)

*Primary Examiner* — Dorothy Harris
(74) *Attorney, Agent, or Firm* — Maier & Maier, PLLC

(57) ABSTRACT

A pixel drive circuit, including a data input circuit, a switch circuit, an energy storage circuit and a light-emitting control circuit. The light-emitting control circuit has a control end connected to the data input circuit, an input connected to a first power supply, and an output connected to an anode of a light-emitting device. A cathode of the light-emitting device is connected to a second power supply. The first power supply outputs a low-potential voltage in a reset phase, and outputs a first high-potential voltage in a compensation phase, a writing phase and a light-emitting phase. The second power supply outputs a second high-potential voltage in the reset, compensation and writing phases, and output a low-potential voltage in the light-emitting phase. The switch circuit is switched on in the reset, compensation and light-emitting phases, and is switched off in the writing phase.

18 Claims, 2 Drawing Sheets

(56) References Cited

U.S. PATENT DOCUMENTS

| | | | | |
|---|---|---|---|---|
| 2018/0226018 | A1 | 8/2018 | Han et al. | |
| 2019/0304361 | A1 | 10/2019 | Lu et al. | |
| 2020/0265780 | A1* | 8/2020 | Qing | G09G 3/3233 |
| 2020/0273402 | A1* | 8/2020 | Seo | G09G 3/3233 |
| 2022/0101777 | A1* | 3/2022 | Kim | G09G 3/3233 |
| 2022/0358880 | A1* | 11/2022 | Yonebayashi | G09G 3/3233 |

FOREIGN PATENT DOCUMENTS

| | | | |
|---|---|---|---|
| CN | 113160754 | A | 7/2021 |
| CN | 114999400 | A | 9/2022 |
| WO | 2016146053 | A1 | 9/2016 |

OTHER PUBLICATIONS

Chinese Search report dated Jan. 6, 2023 in corresponding application No. 202211498015.6; 6 pages.

* cited by examiner

PIXEL DRIVE CIRCUIT AND DISPLAY PANEL

CROSS-REFERENCE TO RELATED APPLICATION

Pursuant to 35 U.S.C. § 119 and the Paris Convention, this application claims the benefit of Chinese Patent Application No. 202211498015.6 filed on Nov. 28, 2022, the content of which is incorporated herein by reference.

TECHNICAL FIELD

The present application relates to the field of display technology, and in particular, to a pixel drive circuit and a display panel.

BACKGROUND

The statements provided herein are merely background information related to the present application, and do not necessarily constitute any prior arts. Light-emitting devices, such as an organic light-emitting diode (OLED), due to their characteristics such as, thin and lightness, energy efficient, wide viewing angle, wide color gamut and high contrast have gradually been widely used in TV, mobile phones, notebooks and other products.

Among them, the OLED is a current-driven light-emitting device. During operation, a driving current is provided through the pixel drive circuit. When a current flows through the OLED, the OLED emits light, and the luminance is determined by the current flowing through the OLED.

Due to the non-uniformity of a drive thin-film transistor in the pixel drive circuit during preparation and the aging of materials, a threshold voltage of the drive thin-film transistor in the pixel drive circuit will drift, which will lead to changes in the driving current of the OLED and affect an image quality of the display panel.

SUMMARY

In view of this, the present application provides a pixel drive circuit and a display panel, to reduce a variation of a driving current of a light-emitting device in the pixel drive circuit and improve the image quality of the display panel.

To achieve the above objective, in accordance with a first aspect, an embodiment of the present application provides a pixel drive circuit, including: a data input circuit, a switch circuit, an energy storage circuit and a light-emitting control circuit.

The data input circuit is in electrical connection with a control end of the light-emitting control circuit, and is configured to output a data voltage to the control end of the light-emitting control circuit in a reset phase, a compensation phase and a writing phase;

An end of the energy storage circuit is in electrical connection with the control end of the light-emitting control circuit through the switch circuit, and another end of the energy storage circuit is in electrical connection with an output of the light-emitting control circuit. The energy storage circuit is configured to store electrical energy.

An input of the light-emitting control circuit is in electrical connection with a first power supply, the output of the light-emitting control circuit is in electrical connection with an anode of a light-emitting device, and the light-emitting control circuit is configured to output a driving current to the light-emitting device in a light-emitting phase. A cathode of the light-emitting device is in electrical connection with a second power supply.

The switch circuit is switched on in the reset phase, the compensation phase and the light-emitting phase, and switched off in the writing phase.

The first power supply outputs a low-potential voltage in the reset phase, and outputs a first high-potential voltage in the compensation phase, the writing phase and the light-emitting phase.

The second power supply outputs a second high-potential voltage in the reset phase, the compensation phase and the writing phase, and outputs a low-potential voltage in the light-emitting phase, and the first high-potential voltage is less than or equal to the second high-potential voltage.

As an optional implementation of the embodiment of the present application, the switch circuit includes a first switch transistor and a first scan line. A first electrode of the first switch is in electrical connection with the control end of the light-emitting control circuit, a second electrode of the first switch transistor is in electrical connection with the output of the light-emitting control circuit, and a control electrode of the first switch transistor is in electrical connection with an output of the first scan line As an optional implementation of the embodiment of the present application, the first switch is an N-channel metal oxide semiconductor (NMOS) transistor, and the first scan line outputs a high-potential signal in the reset phase, the compensation phase and the light-emitting phase, and outputs a low-potential signal in the writing phase.

As an optional implementation of the embodiment of the present application, the light-emitting control circuit includes a drive thin-film transistor. A first electrode of the drive thin-film transistor is in electrical connection with the first power supply, a second electrode of the drive thin-film transistor is in electrical connection with the anode of the light-emitting device, and a control electrode of the drive thin-film transistor is in electrical connection with an output of the data input circuit.

As an optional implementation of the embodiment of the present application, the drive thin-film transistor is a depletion NMOS transistor.

As an optional implementation of the embodiment of the present application, the data input circuit includes a second switch transistor, a data line and a second scan line. A first electrode of the second switch is in electrical connection with an output of the data line, a second electrode of the second switch is in electrical connection with the control end of the light-emitting control circuit, and a control electrode of the second switch is in electrical connection with an output of the second scan line.

As an optional implementation of the embodiment of the present application, the data line outputs a low-potential data voltage in the reset phase, the compensation phase, and the light-emitting phase, and outputs a high-potential data voltage in the writing phase.

As an optional implementation of the embodiment of the present application, the energy storage circuit includes a capacitor.

As an optional implementation of the embodiment of the present application, the light-emitting device is an organic light-emitting diode.

In accordance with a second aspect, an embodiment of the present application provides a display panel, including a plurality of pixel units, each pixel unit includes the light-emitting device and the pixel drive circuit as described in the first aspect or any one of the first aspect.

The pixel drive circuit or the display panel provided in the embodiment of the present application includes a data input circuit, a switch circuit, an energy storage circuit, and a light-emitting control circuit. The data input circuit is in electrical connection with a control end of the light-emitting control circuit, and is configured to output a data voltage to the control end of the light-emitting control circuit in the writing phase. One end of the energy storage circuit is in electrical connection with the control end of the light-emitting control circuit through a switch circuit, and the other end of the energy storage circuit is in electrical connection with an output of the light-emitting control circuit. The energy circuit is configured to store electric energy. An input of the light-emitting control circuit is in electrical connection with a first power supply, the output of the light-emitting control circuit is in electrical connection with an anode of the light-emitting device, and the light-emitting control circuit is configured to output a driving current to the light-emitting device in the light-emitting phase. A cathode of the device is in electrical connection with a second power supply. The switch circuit is switched on in the reset phase, the compensation phase and the light-emitting phase, and is switched off in the writing phase. The first power supply outputs a low-potential voltage in the reset phase, and outputs a first high-potential voltage in the compensation phase, the writing phase and the light-emitting phase. The second power supply outputs a second high-potential voltage in the reset phase, the compensation phase and the writing phase, and outputs a low-potential voltage in the light-emitting phase, and the first high-potential voltage is less than or equal to the second high-potential voltage. In the above technical solution, in the reset, compensation and writing phases, the data input circuit outputs the data voltage to the control end of the light-emitting control circuit (that is, the gate of the drive thin-film transistor), the light-emitting control circuit is switched on, and the first power supply supplies power to charge the output of the light-emitting control circuit (that is, the source of the drive thin-film transistor) to compensate the voltage at the output of the light-emitting control circuit until the light-emitting control circuit is switched off (since the voltage of the first power supply is less than or equal to the voltage of the second power supply at this time, there is no forward current passing through the light-emitting device, the light-emitting device does not emit light). Thus, the driving current of the light-emitting device can be controlled according to the data voltage in the light-emitting phase, so that the driving current of the light-emitting device is independent from the threshold voltage of the drive thin-film transistor of the light-emitting device and the voltage of the first power supply, which not only can eliminate the influence of the threshold voltage drift of the drive thin-film transistor of the light-emitting device on the driving current of the light-emitting device, reduce the variation of the driving current of the light-emitting device, improve the image quality of the display panel, but also can reduce a difference in driving current of each light-emitting device caused by a distance difference between the first power supply and each light-emitting device, and improve the uniformity of the brightness of the display screen. Moreover, in this solution, the number of switches in the pixel drive circuit is small, so that an area of the pixel drive circuit can be reduced, thereby more pixels can be installed in a display screen of the same size, and thus the resolution of the display screen is improved.

DETAILED DESCRIPTION

Embodiments of the present application are described below with reference to the drawings in the embodiments of the present application. The terms used in implementations of the embodiments of the present application are only used to explain the specific embodiments of the present application, and are not intended to limit the present application. The following specific embodiments may be combined with each other, and the same or similar concepts or processes may not be repeated in some embodiments.

The light-emitting device in the embodiments of the present application may be any one of an OLED, an inorganic light-emitting diode (LED), a quantum dot light-emitting diode (QLED) and a submillimeter light-emitting diode (Mini Light Emitting Diodes, Mini LED). In the following, the light-emitting device is an OLED as an example for exemplary description of the embodiments.

Figure 1:
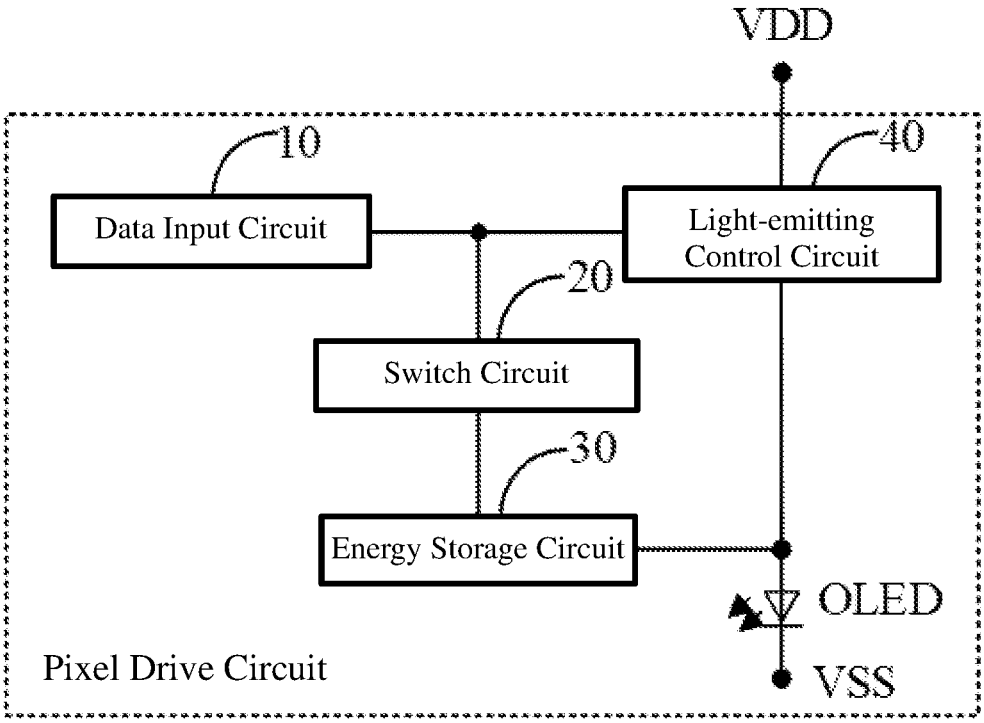
FIG. 1 is a schematic structural diagram of any pixel unit in a display panel in accordance with an embodiment of the present application.

The display panel provided by the embodiment of the present application may include a plurality of pixel units. FIG. 1 is a schematic structural diagram of any pixel unit in the display panel in accordance with an embodiment of the present application. As shown in FIG. 1, the pixel unit may include: a first power supply VDD, a second power supply VSS, a pixel drive circuit and an OLED.

The pixel drive circuit may include a data input circuit 10, a switch circuit 20, an energy storage circuit 30 and a light-emitting control circuit 40.

The data input circuit 10 is in electrical connection with a control end of the light-emitting control circuit 40, and configured to output a data voltage to the control end of the light-emitting control circuit 40 in a reset phase, a compensation phase and a writing phase.

One end of the energy storage circuit 30 is in electrical connection with the control end of the light-emitting control circuit 40 through the switch circuit 20, and the other end of the energy storage circuit 30 is in electrical connection with an output of the light-emitting control circuit 40, and the energy storage circuit 30 is configured for storing electric energy.

An input of the light-emitting control circuit 40 is in electrical connection with the first power supply VDD, the output of the light-emitting control circuit is in electrical connection with an anode of the OLED, and the light-emitting control circuit 40 is configured to output a driving current to the OLED during a light-emitting phase. A cathode of the OLED is in electrical connection with the second power supply VSS.

The switch circuit 20 is switched on during the reset phase, the compensation phase and the light-emitting phase, and is switched off during the writing phase.

The first power supply VDD may output a low-potential voltage in the reset phase, and output a first high-potential voltage in the compensation phase, writing phase and light-emitting phase.

The second power supply VSS may output a second high-potential voltage in the reset phase, compensation phase and writing phase, and output a low-potential voltage in the light-emitting phase, and the first high-potential voltage may be equal to the second high-potential voltage.

In the reset, compensation and writing phases, the data voltage from the data input circuit 10 is output to the control end of the light-emitting control circuit 40 (that is, a gate of the drive thin-film transistor), the light-emitting control circuit 40 is switched on, and the output of the light-emitting control circuit 40 (that is, a source of the drive thin-film transistor) is charged by the first power supply VDD to compensate the voltage at the output of the light-emitting control circuit 40 until the light-emitting control circuit 40 is switched off (because the voltage of the first power supply VDD is equal to the voltage of the second power supply VSS at this time, no forward current passes through the OLED, and the OLED does not emit light), thus the driving current of the OLED can be controlled according to the data voltage in the light-emitting phase, so that the driving current of the OLED is independent from the threshold voltage of the drive thin-film transistor of the OLED and the voltage of the first power supply VDD, which not only can eliminate the influence of the threshold voltage drift of the drive thin-film transistor of the OLED on the driving current of the OLED, reduce the variation of the driving current of the OLED, improve the image quality of the display panel, but also can reduce a difference in driving current of each OLED caused by a distance difference between the first power supply VDD and each OLED, and improve the uniformity of brightness of the display screen. Moreover, in this solution, the number of switches in the pixel drive circuit is small, so that an area of the pixel drive circuit can be reduced, which enables more pixels to be installed in a display screen of the same size, and increases a resolution of the display screen, thereby enabling the display screen to be better applied for high-resolution fields such as virtual reality (VR).

It can be understood that the first high-potential voltage may also be lower than the second high-potential voltage, so that a reverse bias voltage may be applied to the OLED during the reset phase, compensation phase, and writing phase to consume excess electrons and holes in the OLED, so that the luminous intensity and luminous rate of the OLED can be improved in the light-emitting phase, and thus the display effect is improved.

Figure 2:
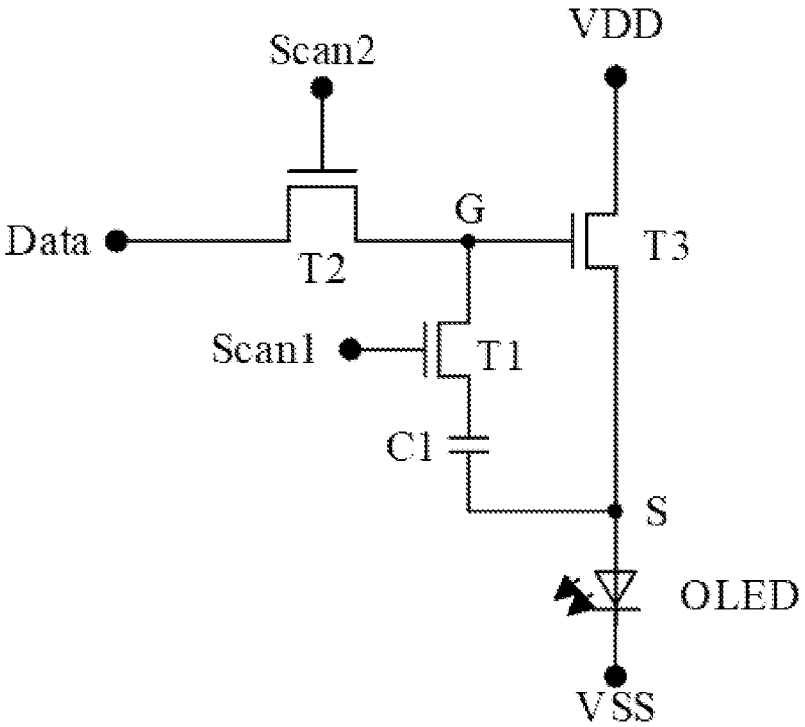
FIG. 2 is a schematic diagram of a circuit structure of a pixel drive circuit in FIG. 1.

FIG. 2 is a schematic diagram of a circuit structure of the pixel drive circuit in FIG. 1. As shown in FIG. 2, the switch circuit 20 may include a first switch T1 and a first scan line Scan1, a first electrode of the first switch T1 is in electric connection with the control end of the light-emitting control circuit 40, a second electrode of the first switch T1 is in electrical connection with the output of the light-emitting control circuit 40, and a control electrode of the first switch T1 is in electrical connection with an output of the first scan line Scan1.

The data input circuit 10 may include a second switch T2, a data line Data and a second scan line Scan2, a first electrode of the second switch T2 is in electrical connection with an output of the data line Data, a second electrode of the second switch T2 is in electrical connection with the control end of the light-emitting control circuit 40, and a control electrode of the second switch T2 is in electrical connection with an output of the second scan line Scan2.

The data line Data may output a low-potential data voltage in the reset phase, the compensation phase, and the light-emitting phase, and output a high-potential data voltage in the writing phase.

The first switch T1 and the second switch T2 may be P-channel metal oxide semiconductor (PMOS) transistors or N-channel metal oxide semiconductor (NMOS) transistors. In case that the first switch T1 and the second switch T2 are PMOS transistors, the first electrodes of the first switch T1 and the second switch T2 are respectively a source, the second electrodes of the first switch T1 and the second switch T2 are respectively a drain, and the control electrodes of the first switch T1 and the second switch T2 are respectively a gate. In case that the first switch T1 and the second switch T2 are NMOS transistors, the first electrodes of the first switch T1 and the second switch T2 are respectively the drain, the second electrodes of the first switch T1 and the second switch T2 are respectively the source, and the control electrode of the first switch T1 and the second switch T2 are respectively the gate. In the following embodiments, the first switch T1 and the second switch T2 are NMOS transistors as an example for exemplary description.

In the reset phase and compensation phase, the first scan line Scan1 and the second scan line Scan2 both output high-potential signals, and the first switch T1 and the second switch T2 are all switched on. In the writing phase, the first scan line Scan1 outputs a low-potential signal, the second scan line Scan2 continues to output a high-potential signal, the first switch T1 is switched off, and the second switch T2 is switched on. In the light-emitting phase, the first scan line Scan1 outputs a high-potential signal, and the second scan line Scan2 continues to output a low-potential signal, the first switch T1 is switched on, and the second switch T2 is switched off.

The light-emitting control circuit 40 may include a drive thin-film transistor T3, a first electrode of the drive thin-film transistor T3 is in electrical connection with the first power supply VDD, a second electrode of the drive thin-film transistor T3 is in electrical connection with the anode of the OLED, and a control electrode of the drive thin-film transistor T3 is in electrical connection with the source of the second switch T2.

The drive thin-film transistor T3 may be a depletion NMOS transistor, and then the first electrode of the drive thin-film transistor T3 is the drain, the second electrode of the drive thin-film transistor T3 is the source, and the control electrode of the drive thin-film transistor T3 is the gate. The drive thin-film transistor T3 may also be other types of NMOS transistors, which will not be specifically limited in this embodiment. In the following embodiments, the drive thin-film transistor T3 is a depletion NMOS transistor as an example for exemplary description.

The energy storage circuit 30 may include a capacitor C1, one end of the capacitor C1 is in electrical connection with the gate of the drive TFT T3 through the first switch T1, and the other end of the capacitor C1 is in electrical connection with the source of the drive TFT T3.

Figure 3:
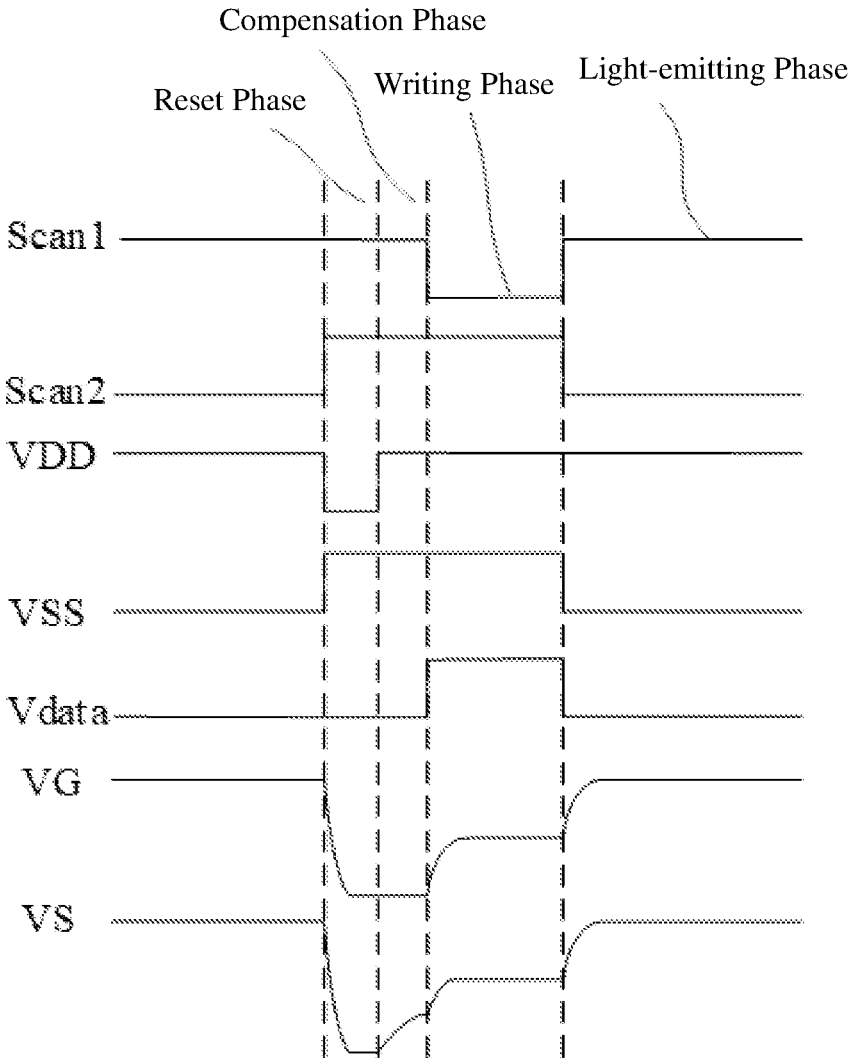
FIG. 3 is an operation time sequence diagram of the pixel drive circuit in accordance with an embodiment of the present application.

FIG. 3 is an operation time sequence diagram of the pixel drive circuit in accordance with an embodiment of the present application. As shown in FIG. 3, in the reset phase, the first power supply VDD outputs a low-potential voltage, the second power supply VSS outputs a second high-potential voltage, and the first scan line Scan1 and the second scan line Scan2 both output high-potential signals, the first switch T1 and the second switch T2 are switched on, the low-potential voltage Vref output from the data line Data is written into at the point G, and the drive thin-film transistor T3 is switched on, and the low-potential voltage output by the first power supply VDD is written into at the point S. Although the drive thin-film transistor T3 is switched on in this phase, the low-potential voltage output by the first power supply VDD is lower than the second high-potential voltage output by the second power supply VSS, and the OLED does not emit light.

In the compensation phase, the first power supply VDD outputs the first high-potential voltage, the second power supply VSS continues to output the second high-potential voltage, the first scan line Scan1 and the second scan line Scan2 still output high-potential signals, the first switch T1 and the second switch T2 continue to be switched on, the drive thin-film transistor T3 is switched on, and the first power supply VDD continues to charge the point S. when the voltage at the point S is charged to Vref−Vth (Vth is the threshold voltage of the drive thin-film transistor T3), at this time, the drive thin-film transistor T3 is in the critical cut-off region, and the compensation phase ends. Although the drive thin-film transistor T3 is switched on in this phase, the first high-potential voltage output by the first power supply VDD is not higher than the second high-potential voltage output by the second power supply VSS, and the OLED does not emit light.

In the writing phase, the first power supply VDD continues to output the first high-potential voltage, the second power supply VSS continues to output the second high-potential voltage, the first scan line Scan1 outputs a low-potential signal, the first switch T1 is switched off, and the potential variations at the points G and S do not affect each other. The second scan line Scan2 still outputs a high-potential signal, the second switch T2 continues to be switched on, and the high-potential voltage Vdata output by the data line Data is written into at the point G. Since the gate voltage of the drive thin-film transistor T3 is increased, the drive thin-film transistor T3 is switched on again, the first power supply VDD charges the point S. Since the drive thin-film transistor T3 is in a saturation phase at this time, the potential of the point S varies slowly, and a variation in potential at the point S is ΔV1, that is, the voltage at point S at this time is that VS=Vref−Vth+ΔV1, where ΔV1 is in a positive correlation with an electron mobility of the drive thin-film transistor T3. In this phase, the first high-potential voltage output by the first power supply VDD is not higher than the second high-potential voltage output by the second power supply VSS, and the OLED still does not emit light.

In the light-emitting phase, the first power supply VDD continues to output the first high-potential voltage, the second power supply VSS outputs a low-potential voltage, and the thin-film transistor T3 is switched on, the first high-potential voltage output by the first power supply VDD is higher than the low-potential voltage output by the second power supply VS, and the OLED emits light. In this phase, the first scan line Scan1 outputs a high-potential signal, the first switch T1 is switched on, the second scan line Scan2 outputs a low-potential signal, the second switch T2 is switched off, and the voltage at point S is that VS=VSS+Voled, where Voled is the voltage of the OLED. Compared with the writing phase, the voltage variation at point S is VSS+Voled−(Vref−Vth+ΔV1). Due to the coupling effect of capacitor C1, the voltage variations at point G and point S are the same. Thus, the voltage at point G in the light-emitting phase is that VG=Vdata+(VSS+Voled−(Vref−Vth+ΔV1)).

The voltage at the gate of the drive thin-film transistor T3 with respect to the source of the drive thin-film transistor T3 is that Vgs=VG−VS=Vdata−(Vref−Vth+ΔV1). In accordance with a calculation formula of OLED driving current, the following formula is determined that:

$$I_{OLED}=\tfrac{1}{2}\mu_n C_{ox} W/L(Vgs-Vth)^2=\tfrac{1}{2}\mu_n C_{ox} W/L(\text{Vdata}-\text{Vref}-\Delta V1)^2$$

Where, $I_{OLED}$ is the driving current of the OLED, $\mu_n$ is an electron mobility of the drive thin-film transistor T3, $C_{ox}$ is a capacitance per unit area of a gate oxide layer of the drive thin-film transistor T3, and W/L is a width-to-length ratio of the drive thin-film transistor.

According to the above formula, in the pixel drive circuit provided by the present application, the driving current of the OLED is only related to the data voltage Vdata and Vref (ΔV1 is proportional to $\mu_n$, which is a fixed value), and is independent from the threshold voltage of the drive thin-film transistor T3 and the voltage of the first power supply VDD. In this way, not only the influence of the threshold voltage drift of the drive thin-film transistor of the OLED on the driving current of the OLED can be eliminated, the variation of the driving current of the OLED is reduced, and the image quality of the display panel is improved, but also a difference in driving current of each OLED caused by a distance difference between the first power supply VDD and each OLED can be reduced, and the uniformity of brightness of the display screen is improved.

It can be understood that the circuit modules illustrated in the embodiments of the present application do not constitute a specific limitation on the pixel drive circuit. In other embodiments of the present application, the pixel drive circuit may include more or fewer circuit modules than shown in the figures, or some circuit modules are combined, or some circuit modules are split. Each circuit module may include more or fewer devices than shown in the figures. The illustrated circuit modules may be implemented in hardware, software or a combination of software and hardware.

The pixel drive circuit or the display panel provided in the embodiment of the present application includes a data input circuit, a switch circuit, an energy storage circuit, and a light-emitting control circuit. The data input circuit is in electrical connection with a control end of the light-emitting control circuit, and is configured to output a data voltage to the control end of the light-emitting control circuit in the writing phase. One end of the energy storage circuit is in electrical connection with the control end of the light-emitting control circuit through a switch circuit, and the other end of the energy storage circuit is in electrical connection with an output of the light-emitting control circuit. The energy circuit is configured to store electric energy. An input of the light-emitting control circuit is in electrical connection with a first power supply, the output of the light-emitting control circuit is in electrical connection with an anode of the light-emitting device, and the light-emitting control circuit is configured to output a driving current to the light-emitting device in the light-emitting phase. A cathode of the device is in electrical connection with a second power supply. The switch circuit is switched on in the reset phase, the compensation phase and the light-emitting phase, and is switched off in the writing phase. The first power supply outputs a low-potential voltage in the reset phase, and outputs a first high-potential voltage in the compensation phase, the writing phase and the light-emitting phase. The second power supply outputs a second high-potential voltage in the reset phase, the compensation phase and the writing phase, and outputs a low-potential voltage in the light-emitting phase, and the first high-potential voltage is less than or equal to the second high-potential voltage. In the above technical solution, in the reset, compensation and writing phases, the data input circuit outputs the data voltage to the control end of the light-emitting control circuit (that is, the gate of the drive thin-film transistor), the light-emitting control circuit is switched on, and the first power supply supplies power to charge the output of the light-emitting control circuit (that is, the source of the drive thin-film transistor) to compensate the voltage at the output of the light-emitting control circuit until the light-emitting control circuit is switched off (since the voltage of the first power supply is less than or equal to the voltage of the second power supply at this time, there is no forward current passing through the light-emitting device, the light-emitting device does not emit light). Thus, the driving current of the light-emitting device can be controlled according to the data voltage in the light-emitting phase, so that the driving current of the light-emitting device is independent from the threshold voltage of the drive thin-film transistor of the light-emitting device and the voltage of the first power supply, which not only can eliminate the influence of the threshold voltage drift of the drive thin-film transistor of the light-emitting device on the driving current of the light-emitting device, reduce the variation of the driving current of the light-emitting device, improve the image quality of the display panel, but also can reduce a difference in driving current of each light-emitting device caused by a distance difference between the first power supply and each light-emitting device, and improve the uniformity of the brightness of the display screen. Moreover, in this solution, the number of switches in the pixel drive circuit is small, so that an area of the pixel drive circuit can be reduced, thereby more pixels can be installed in a display screen of the same size, and thus the resolution of the display screen is improved.

In the above embodiments, the descriptions of each embodiment have their own emphases, and for parts that are not detailed or recorded in a certain embodiment, references may be made to the relevant descriptions of other embodiments.

It should be understood that the term "comprising", when used in the specification and claims of the present application, indicates a presence of described features, integers, steps, operations, elements and/or components, but does not exclude the presence or addition of one or more other features, wholes, steps, operations, elements, components and/or combinations thereof.

The naming or numbering of the steps in the present application does not mean that the steps in the method flow must be executed in the time/logic sequence indicated by the naming or numbering. The order of execution for the named or numbered process steps can be changed based on the technical objectives to be achieved, as long as the same or similar technical effect can be achieved.

In the description of the present application, unless otherwise specified, "I" means that the objects associated with each other are an "or" relationship, for example, AB may mean A or B. the expression "and/or" in the present application is only an association relationship describing associated objects, which means that three kinds of relationships may be included, for example, A and/or B, may include three cases, that is, A exists alone, both A and B exist, and B exists alone, among which A, B C may be singular or plural.

In addition, in the description of the present application, unless otherwise specified, the phrase "a plurality of" means two or more than two. "at least one of the following" or similar expressions refer to any combination of these items, including any combination of single items or plural items. For example, at least one of a, b, or c may include that: a, b, c, a-b, a-c, b-c, or a-b-c, wherein a, b, c may be singular or plural.

As used in the specification and the appended claims of the present application, the term "if" may be construed, depending on the context, as "when" or "once" or "in response to determining" or "in response to detecting". Similarly, the phrase "if determined" or "if [the described condition or event] is detected" may be construed, depending on the context, to mean "once determined" or "in response to the determination" or "once detected [the described condition or event]" or "in response to detection of [described condition or event]".

In addition, in the description of the specification and the appended claims of the present application, the terms "first", "second", "third" and so on are used to distinguish similar objects, and are not necessarily used to describe a specific order or sequence order. It should be understood that the terms so used are interchangeable under appropriate circumstances such that the embodiments described herein can be practiced in sequences other than those illustrated or described herein.

References to "one embodiment" or "some embodiments" or the like described in the specification of the present application mean that a particular feature, structure or characteristic described in connection with that embodiment is included in one or more embodiments of the present application. Thus, appearances of the phrases "in one embodiment," "in some embodiments," "in other embodiments," "in some other embodiments," etc. in various places in this specification are not necessarily all refer to the same embodiment, but mean "one or more but not all embodiments" unless specifically stated otherwise.

Finally, it should be noted that: the above embodiments are only used to illustrate the technical solutions of the present application, and are not intended to limit it. Although the present application has been described in detail with reference to the foregoing embodiments, those of ordinary skills in the art should understand that the technical solutions described in the foregoing embodiments may still be modified, or some or all of the technical features thereof may be equivalently replaced; and these modifications or replacements do not make the essence of the corresponding technical solutions deviate from the scope pf the technical solutions of the various embodiments of the present application.

What is claimed is:

1. A pixel drive circuit, comprising: a data input circuit, a switch circuit, an energy storage circuit and a light-emitting control circuit;

wherein the data input circuit is in electrical connection with a control end of the light-emitting control circuit and is configured to output a data voltage to the control end of the light-emitting control circuit in a reset phase, a compensation phase, and a writing phase;

an end of the energy storage circuit is in electrical connection with the control end of the light-emitting control circuit through the switch circuit, and another end of the energy storage circuit is in electrical connection with an output of the light-emitting control circuit, and the energy storage circuit is configured to store electrical energy;

an input of the light-emitting control circuit is in electrical connection with a first power supply, the output of the light-emitting control circuit is in electrical connection with an anode of a light-emitting device, and the light-emitting control circuit is configured to output a driving current to the light-emitting device in a light-emitting phase; and a cathode of the light-emitting device is in electrical connection with a second power supply;

the switch circuit is switched on in the reset phase, the compensation phase, and the light-emitting phase, and is switched off in the writing phase;

the first power supply outputs a low-potential voltage during the reset phase and outputs a first high-potential voltage during the compensation phase, the writing phase, and the light-emitting phase; and the second power supply outputs a second high-potential voltage in the reset phase, the compensation phase, and the writing phase, and outputs a low-potential voltage during the light-emitting phase, and the first high-potential voltage is less than or equal to the second high-potential voltage.

2. The pixel drive circuit according to claim 1, wherein the switch circuit comprises a first switch and a first scan line, a first electrode of the first switch is in electrical connection with the control end of the light-emitting control circuit, a second electrode of the first switch transistor is in electrical connection with the output of the light-emitting control circuit, and a control electrode of the first switch transistor is in electrical connection with an output of the first scan line.

3. The pixel drive circuit according to claim 2, wherein the first switch is an N-channel metal oxide semiconductor (NMOS) transistor, and the first scan line outputs a high-potential signal in the reset phase, the compensation phase, and the light-emitting phase, and outputs a low-potential signal in the writing phase.

4. The pixel drive circuit according to claim 1, wherein the light-emitting control circuit comprises a drive thin-film transistor, a first electrode of the drive thin-film transistor is in electrical connection with the first power supply, a second electrode of the drive thin-film transistor is in electrical connection with the anode of the light-emitting device, and a control electrode of the drive thin-film transistor is in electrical connection with an output of the data input circuit.

5. The pixel drive circuit according to claim 4, wherein the drive thin-film transistor is a depletion NMOS transistor.

6. The pixel drive circuit according to claim 1, wherein the data input circuit comprises a second switch, a data line, and a second scan line, a first electrode of the second switch is in electrical connection with an output of the data line, a second electrode of the second switch is in electrical connection with the control end of the light-emitting control circuit, and a control electrode of the second switch is in electrical connection with an output of the second scan line.

7. The pixel drive circuit according to claim 6, wherein the data line outputs a low-potential data voltage in the reset phase, the compensation phase, and the light-emitting phase, and outputs a high-potential data voltage during the writing phase.

8. The pixel drive circuit according to claim 1, wherein the energy storage circuit comprises a capacitor.

9. The pixel drive circuit according to claim 1, wherein the light-emitting device is an organic light-emitting diode.

10. A display panel, comprising:

a plurality of pixel units, each pixel unit comprising:

a light-emitting device; and a pixel drive circuit, comprising: a data input circuit, a switch circuit, an energy storage circuit and a light-emitting control circuit;

wherein the data input circuit is in electrical connection with a control end of the light-emitting control circuit, and is configured to output a data voltage to the control end of the light-emitting control circuit in a reset phase, a compensation phase, and a writing phase;

an end of the energy storage circuit is in electrical connection with the control end of the light-emitting control circuit through the switch circuit, and another end of the energy storage circuit is in electrical connection with an output of the light-emitting control circuit, the energy storage circuit is configured to store electrical energy;

an input of the light-emitting control circuit is in electrical connection with a first power supply, the output of the light-emitting control circuit is in electrical connection with an anode of the light-emitting device, and the light-emitting control circuit is configured to output a driving current to the light-emitting device in a light-emitting phase; a cathode of the light-emitting device is in electrical connection with a second power supply;

the switch circuit is switched on in the reset phase, the compensation phase and the light-emitting phase, and switched off in the writing phase;

the first power supply outputs a low-potential voltage during the reset phase, and outputs a first high-potential voltage during the compensation phase, the writing phase and the light-emitting phase; and the second power supply outputs a second high-potential voltage in the reset phase, the compensation phase and the writing phase, and outputs a low-potential voltage during the light-emitting phase, and the first high-potential voltage is less than or equal to the second high-potential voltage.

11. The display panel according to claim 10, wherein the switch circuit comprises a first switch and a first scan line, a first electrode of the first switch is in electrical connection with the control end of the light-emitting control circuit, a second electrode of the first switch transistor is in electrical connection with the output of the light-emitting control circuit, and a control electrode of the first switch transistor is in electrical connection with an output of the first scan line.

12. The display panel according to claim 11, wherein the first switch is an NMOS transistor, and the first scan line outputs a high-potential signal in the reset phase, the compensation phase, and the light-emitting phase, and outputs a low-potential signal in the writing phase.

13. The display panel according to claim 10, wherein the light-emitting control circuit comprises a drive thin-film transistor, a first electrode of the drive thin-film transistor is in electrical connection with the first power supply, a second electrode of the drive thin-film transistor is in electrical connection with the anode of the light-emitting device, and a control electrode of the drive thin-film transistor is in electrical connection with an output of the data input circuit.

14. The display panel according to claim 13, wherein the drive thin-film transistor is a depletion NMOS transistor.

15. The display panel according to claim 10, wherein the data input circuit comprises a second switch, a data line, and a second scan line, a first electrode of the second switch is in electrical connection with an output of the data line, a second electrode of the second switch is in electrical connection with the control end of the light-emitting control circuit, and a control electrode of the second switch is in electrical connection with an output of the second scan line.

16. The display panel according to claim 15, wherein the data line outputs a low-potential data voltage in the reset phase, the compensation phase, and the light-emitting phase, and outputs a high-potential data voltage during the writing phase.

17. The display panel according to claim 10, wherein the energy storage circuit comprises a capacitor.

18. The display panel according to claim 10, wherein the light-emitting device is an organic light-emitting diode.

* * * * *